US008973919B2

(12) United States Patent
Yokoyama et al.

(10) Patent No.: US 8,973,919 B2
(45) Date of Patent: Mar. 10, 2015

(54) DOUBLE-FEED DETECTION APPARATUS AND IMAGE FORMING APPARATUS

(75) Inventors: Seiji Yokoyama, Numazu (JP); Eiichiro Teshima, Ashigarakami-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/603,745

(22) Filed: Sep. 5, 2012

(65) Prior Publication Data

US 2012/0326386 A1 Dec. 27, 2012

Related U.S. Application Data

(63) Continuation of application No. 12/412,173, filed on Mar. 26, 2009, now Pat. No. 8,282,095.

(30) Foreign Application Priority Data

Mar. 31, 2008 (JP) ..... 2008-091068

(51) Int. Cl.
*B65H 7/12* (2006.01)
*B65H 5/06* (2006.01)
*B65H 7/14* (2006.01)

(52) U.S. Cl.
CPC ..... *B65H 5/062* (2013.01); *B65H 7/14* (2013.01); *B65H 2511/11* (2013.01); *B65H 2511/13* (2013.01); *B65H 2511/416* (2013.01); *B65H 2511/514* (2013.01); *B65H 2511/524* (2013.01); *B65H 2513/511* (2013.01); *B65H 2513/53* (2013.01); *B65H 2553/412* (2013.01); *B65H 2557/23* (2013.01); *B65H 2701/1311* (2013.01); *B65H 2701/1313* (2013.01)
USPC ..... 271/262

(58) Field of Classification Search
USPC ..... 271/262, 263, 265.04, 258.01, 265.01; 399/16, 21, 43, 388
See application file for complete search history.

(56) References Cited

U.S. PATENT DOCUMENTS 7,445,209 B2 * 11/2008 Sano et al. ..... 271/263
7,552,924 B2 * 6/2009 Sano et al. ..... 271/263

* cited by examiner

*Primary Examiner* — Thomas Morrison
(74) *Attorney, Agent, or Firm* — Canon U.S.A., Inc. IP Division

(57) ABSTRACT

A double-feed detection apparatus includes a sensor configured to detect double feed of transfer materials conveyed along a conveying path, and a control unit configured to execute detection of the transfer material under conveyance plural times with the sensor, and to determine the double feed of the transfer materials based on detection results. The control unit determines a detection timing based on both a distance along the conveying path from the sensor to an image forming unit which forms an image on the transfer material and a length of the transfer material in the feed direction.

9 Claims, 11 Drawing Sheets

DOUBLE-FEED DETECTION APPARATUS AND IMAGE FORMING APPARATUS

CROSS-REFERENCE TO RELATED APPLICATIONS

This application is a continuation of U.S. patent application Ser. No. 12/412,173, filed Mar. 26, 2009, which claims the benefit of Japanese Application No. 2008-091068, filed Mar. 31, 2008, both of which are hereby incorporated by reference herein in their entirety.

BACKGROUND OF THE INVENTION

1. Field of the Invention

The present invention relates to a double-feed detection apparatus and an image forming apparatus. More particularly, the present invention relates to detection of double feed of sheet-like members in an apparatus for conveying the sheet-like members, and also relates to an image forming apparatus for forming images on the sheet-like members.

The term "image forming apparatus" implies an apparatus of the type forming an image on a sheet-like member by employing, e.g., electrophotography. Examples of the image forming apparatus include an electrophotographic copying machine, an electrophotographic printer (such as a laser beam printer or an LED printer), a facsimile, and a word processor.

2. Description of the Related Art

In an image forming apparatus such as a copying machine or a laser beam printer, an image has hitherto been formed on a transfer material (sheet-like member) as follows. First, transfer materials set in a sheet-like member stacking unit, which serves as a paper feed unit, are separated one by one. The separated transfer material is conveyed to an image forming section including various image forming units. In the image forming section, a formed image is transferred onto the transfer material by a transfer unit. Thereafter, the image is fused to the transfer material by a fusing unit, and the transfer material is ejected out of the apparatus. The image is formed on the transfer material through the above-described steps. When the transfer materials set in the paper feed unit are separated and conveyed, there may occur such a state that two or more transfer materials are conveyed to the transfer unit or the fusing unit in an overlapped relation (hereinafter referred to as "double feed"). If the transfer materials in the double-feed state are conveyed, as they are, up to the transfer unit or the fusing unit, the fusing unit being located downstream of the transfer unit, in the image forming section for forming the image, the transfer and the fusing are often not performed under appropriate conditions. In other words, the transfer materials need to be prevented from being conveyed in the double-feed state to the transfer unit or the fusing unit, which is the image forming unit for forming the image on the transfer material. In the following description, the transfer unit or the fusing unit is also called a double-feed prohibition unit.

For that reason, a technique has hitherto been widely practiced in which a double-feed detection mechanism for detecting double feed is disposed on a conveying path extending from a position where the transfer material is separated in the paper feed unit to the transfer unit and, upon detection of the double feed, the transfer materials in the double-feed state are stopped before reaching the double-feed prohibition unit, i.e., the transfer unit or the fusing unit in the image forming section.

In the above-described double-feed detection mechanism, if the transfer materials are double-fed with a mutual deviation in the feed direction (hereinafter referred to as "dragged-in double feed"), there is a possibility of generating erroneous detection when the double-feed detection is performed with respect to only the leading end of the transfer material. For example, the dragged-in double feed is not correctly detected (an erroneous detection indicating no double-feed is resulted) in some cases when the double-feed detection is performed with respect to only the leading end of the transfer material.

In view of such a problem, Japanese Patent Laid-Open No. 2001-063872 proposes a double-feed detection mechanism. More specifically, the double-feed detection mechanism includes a light-emitting unit, e.g., an LED, arranged near a conveying path along which a transfer material is conveyed, and a light-receiving unit, e.g., a photo-transistor. Further, a light quantity received by the light-receiving unit is sampled within a sample range on the transfer material in a predetermined number of samples, and double-feed detection is performed based on each sampled light quantity data. Double feed of the transfer materials is determined based on the results of plural double-feed detections obtained from the sample range.

However, the above-described known double-feed detection mechanism has the following problems.

In the above-cited Japanese Patent Laid-Open No. 2001-063872, when the double feed is detected, the determination as to the double feed is made after the completion of all samplings within the sample range. Therefore, when the sample range is larger than the distance from the double-feed detection mechanism to a particular member, such as a roller or a belt, (in the double-feed prohibition unit), the double feed cannot be determined before the transfer material reaches the particular member, such as the roller or the belt. The particular member, such as the roller or the belt, is a member for forming an image on the transfer material in the image forming apparatus. In other words, such a member is included in, e.g., the transfer unit or the fusing unit in which the transfer materials are apt to jam (namely, a paper jam tends to occur) if the transfer materials are conveyed in the double-feed state. Particularly, the fusing unit is a unit in which a difficulty arises in a process of removing the jammed transfer materials after the occurrence of a jam. Thus, it is often difficult to perform a process for coping with a jam occurred when the transfer materials are conveyed in the double-feed state. If a jam occurs, the transfer materials are wastefully consumed. Further, if the transfer materials are conveyed up to the fusing unit in the double or more feed state, the fusing unit may fail.

If the sample range is widened, a light emission time of the light-emitting unit made of, e.g., an LED is prolonged correspondingly and the light-emitting unit is degraded to a larger extent. Large degradation of the light-emitting unit causes such a risk that the quantity of emitted light is reduced and accuracy of the double-feed detection is reduced. Conversely, when an LED capable of stably emitting light for a long time is used, the apparatus cost is increased because of the necessity of using an expensive LED.

SUMMARY OF THE INVENTION

The present invention has been made in view of the above-described state of the art. One exemplary embodiment of the present invention provides an apparatus which can accurately detect double feed of sheet-like members to prevent the sheet-like members from being conveyed in a double-feed state up to a member where a jam is apt to occur or where a jam is difficult to cope with, which can improve efficiency in coping with the jam, and which can prevent a failure of the apparatus.

According to an aspect of the invention, a double-feed detection apparatus is provided that detects double feed of transfer materials. The double-feed detection apparatus includes a conveying path along which the transfer materials are each conveyed, a sensor configured to detect the double feed of the transfer materials conveyed along the conveying path, and a control unit configured to execute detection of the transfer material under conveyance plural times with the sensor, and to determine the double feed of the transfer materials based on detection results, wherein the control unit determines a detection timing of the sensor based on both a distance along the conveying path from the sensor to an image forming unit which forms an image on the transfer material and a length of the transfer material in the feed direction.

According to another aspect of the present invention, an image forming apparatus including a stacking unit in which transfer materials are stacked, a conveying path along which the transfer materials supplied from the stacking unit are each conveyed, a sensor configured to detect the double feed of the transfer materials conveyed along the conveying path, an image forming unit configured to form an image on the transfer material, and a control unit configured to execute detection of the transfer material under conveyance plural times with the sensor, and to determine double feed of the transfer materials based on detection results, wherein the control unit determines a detection timing of the sensor based on both a distance along the conveying path from the sensor to the image forming unit and a length of the transfer material in the feed direction.

Further features of the present invention will become apparent from the following description of exemplary embodiments with reference to the attached drawings.

DESCRIPTION OF THE EMBODIMENTS

Figure 1:
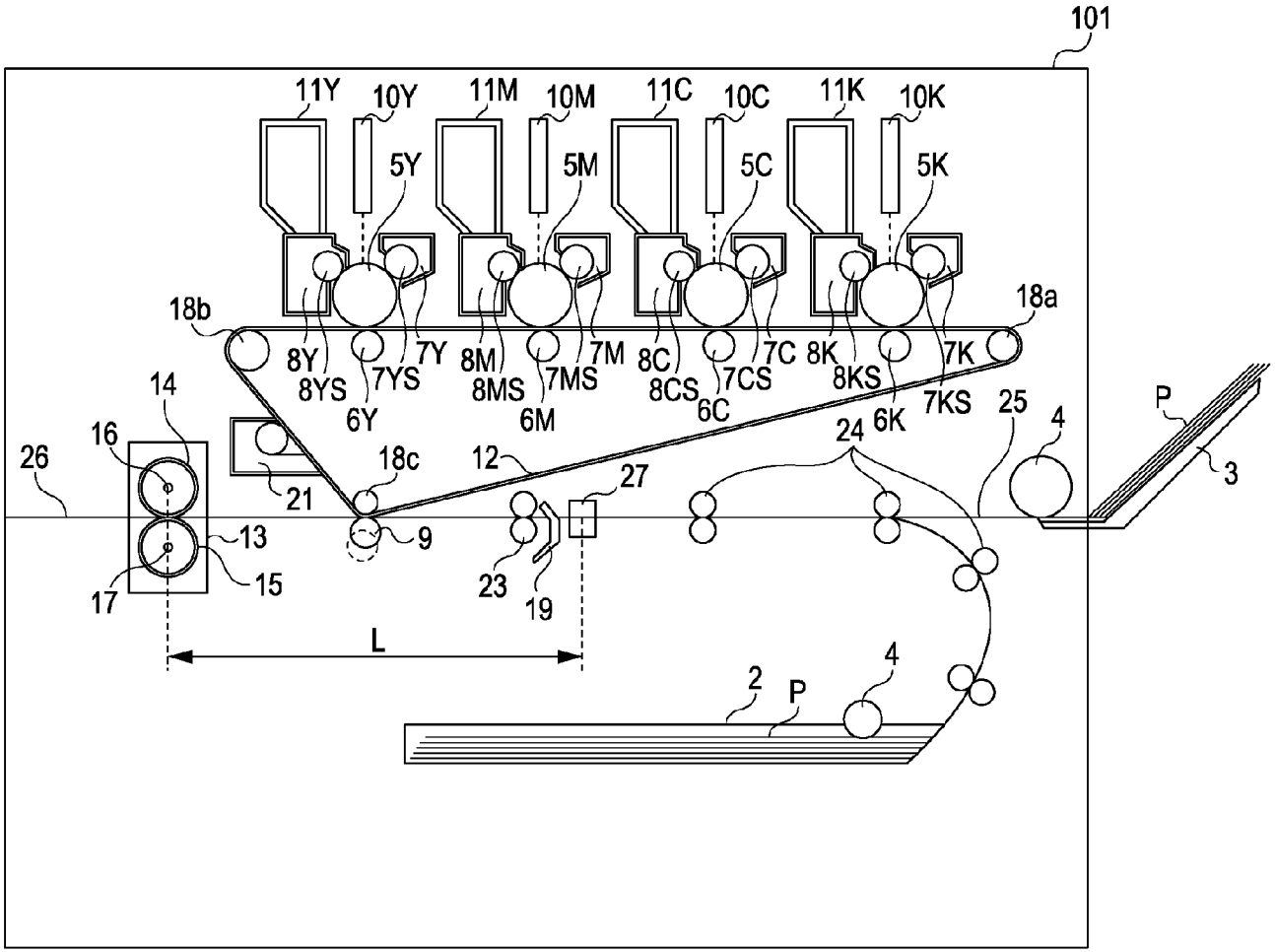
FIG. 1 illustrates an overall construction of a laser printer according to a first exemplary embodiment.

Exemplary embodiments of the present invention will be described in detail for only illustrative purposes with reference to the drawings. It is to be noted that components in the following exemplary embodiments are described for only illustrative purposes, and that the technical scope of the present invention is defined by claims and is not limited by the following exemplary embodiments.

The best mode for carrying out the present invention will be described in detail in connection with the exemplary embodiments.

In a first exemplary embodiment of the present invention, a timing of double-feed detection is determined depending on a length of a transfer material (sheet-like member) in the feed direction, which has a minimum size among the sheet-like members capable of being stacked in a paper feed unit, i.e., a sheet-like member stacking unit.

<Construction of Laser Printer>

An overall construction of a laser printer as an example of an image forming apparatus will be described with reference to FIG. 1.

A laser printer 101 is constructed as follows. The laser printer 101 includes photosensitive drums 5Y, 5M, 5C and 5K, chargers 7Y, 7M, 7C and 7K, and laser scanners 10Y, 10M, 10C and 10K in a one-to-one relation to stations which are arranged side by side corresponding to the number of development colors. Further, the laser printer 101 includes developing units 8Y, 8M, 8C and 8K, and toner cartridges 11Y, 11M, 11C and 11K in the respective stations. Moreover, the laser printer 101 includes an intermediate transfer belt 12, primary transfer rollers 6Y, 6M, 6C and 6K, a secondary transfer roller 9 (transfer unit), a paper feed unit, a fuser 13 (fusing unit), etc. The photosensitive drums 5Y, 5M, 5C and 5K are each formed of an aluminum cylinder coated with an organic photoconductive layer on an outer circumference of the aluminum cylinder, and are rotated counterclockwise, as viewed in FIG. 1, by a driving motor (not shown) when a printing operation is started.

The chargers 7Y, 7M, 7C and 7K include charging sleeves 7YS, 7MS, 7CS and 7KS to perform primary charging of the photosensitive drums 5Y, 5M, 5C and 5K, respectively.

Surfaces of the photosensitive drums 5Y, 5M, 5C and 5K are selectively exposed by the laser scanners 10Y, 10M, 10C and 10K in accordance with signals of input image data (i.e., image signals), thus successively forming electrostatic latent images. The developing units 8Y, 8M, 8C and 8K include respectively developing sleeves 8YS, 8MS, 8CS and 8KS to visualize the electrostatic latent image.

The intermediate transfer belt 12 is an endless belt running over a driving roller 18*a* and driven rollers 18*b* and 18*c* under tension. The intermediate transfer belt 12 is rotated clockwise while contacting the photosensitive drums 5Y, 5M, 5C and 5K. During the rotation, toner images are successively primary-transferred onto the surface of the intermediate transfer belt 12 with primary transfer processes performed by the primary transfer rollers 6Y, 6M, 6C and 6K.

Transfer materials P are stacked in a paper feed cassette 2 or a paper feed tray 3, each of which serves as a paper feed unit. The transfer materials P are each fed (supplied) onto a conveying path 25 by a paper feed roller 4. The transfer material P is conveyed along the conveying path 25 which is constructed of conveying rollers 24, etc., and then reaches the position of a pre-registration sensor 19. The transfer material P is further conveyed through a certain distance. Upon reaching a registration roller 23, the transfer material P forms a loop and comes into a standby state. When the transfer material P in the standby state is conveyed again, the transfer material P is advanced in a sandwiched relation between the intermediate transfer belt 12 and the secondary transfer roller 9 in a state of the secondary transfer roller 9 contacting the intermediate transfer belt 12. Accordingly, color visible images having been multi-transferred onto the intermediate transfer belt 12 are secondary-transferred onto the transfer material P together. The secondary transfer roller 9 comes into contact with the intermediate transfer belt 12 during the secondary transfer, as indicated by a solid line. After the secondary transfer, the secondary transfer roller 9 is moved away from the intermediate transfer belt 12 to a position indicated by a dotted line.

A cleaner container 21 cleans the intermediate transfer belt 12 by a cleaning blade mounted in the cleaner container 21, and holds therein, as waste toner, toner that remains on the intermediate transfer belt 12 after the secondary transfer without being transferred.

The fuser 13 fuses the toner image (developer image) on the transfer material P while the transfer material P is transferred. The fuser 13 includes a fusing roller 14 to heat the toner, and a pressing roller 15 to bring the transfer material P into pressure contact with the fusing roller 14. The fusing roller 14 and the pressing roller 15 are formed to be hollow and include respectively heaters 16 and 17 mounted in their inner spaces. After the toner image on the transfer material P has been fused by the fuser 13, the transfer material P passes through a conveying path 26 and is ejected out of the laser printer 101.

The cleaner container (cleaning unit) 21 removes the toner remaining on the photosensitive drums 5Y, 5M, 5C and 5K and the intermediate transfer belt 12. Waste toner left after transferring the color visible images, which are formed on the intermediate transfer belt 12, onto the transfer material P is held in the cleaner container 21.

Reference numeral 27 denotes a double-feed detection sensor (detection unit) for detecting double feed of the transfer materials P. In the laser printer 101 illustrated in FIG. 1, the double-feed detection sensor 27 is arranged upstream of the registration roller 23 in the transfer-material conveying path to detect the double feed of the transfer materials P passing the sensor.

Figure 2:
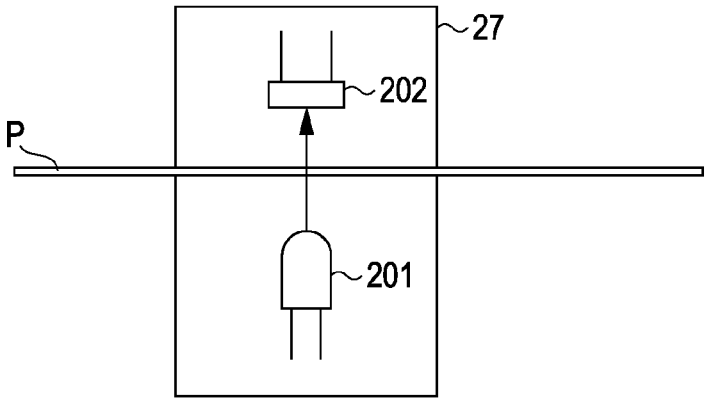
FIG. 2 illustrates an example of a double-feed detection sensor used in the first to third exemplary embodiments.

FIG. 2 illustrates an example of construction of the double-feed detection sensor 27. The double-feed detection sensor 27 includes an LED 201 serving as a light-emitting unit, and a detector 202 serving as a light-receiving unit. The double-feed detection sensor 27 detects the occurrence of double feed based on a light quantity received by the detector 202. In other words, the double-feed detection sensor 27 is a sensor for detecting a quantity of light passing through the transfer material and obtaining information regarding the thickness of the transfer material. The detecting operation of the double-feed detection sensor 27 in this first exemplary embodiment is performed by turning on the LED 201 to emit light for a predetermined time while the transfer material P is conveyed, and detecting the occurrence of double feed when the quantity of light received by the detector 202 is larger than a preset threshold. The light emission time during which the LED 201 is turned on to emit the light is set to, e.g., several tens milliseconds. The threshold is set to a value that is previously obtained with experiments depending on the type of paper (such as ordinary paper, thick paper, or thin paper). Another sensor for detecting, e.g., information with respect to the basis weight of the transfer material can also be used instead of the sensor for detecting information with respect to the thickness of the transfer material.

<Configuration of Double-Feed Detection Control Unit>

Figure 3:
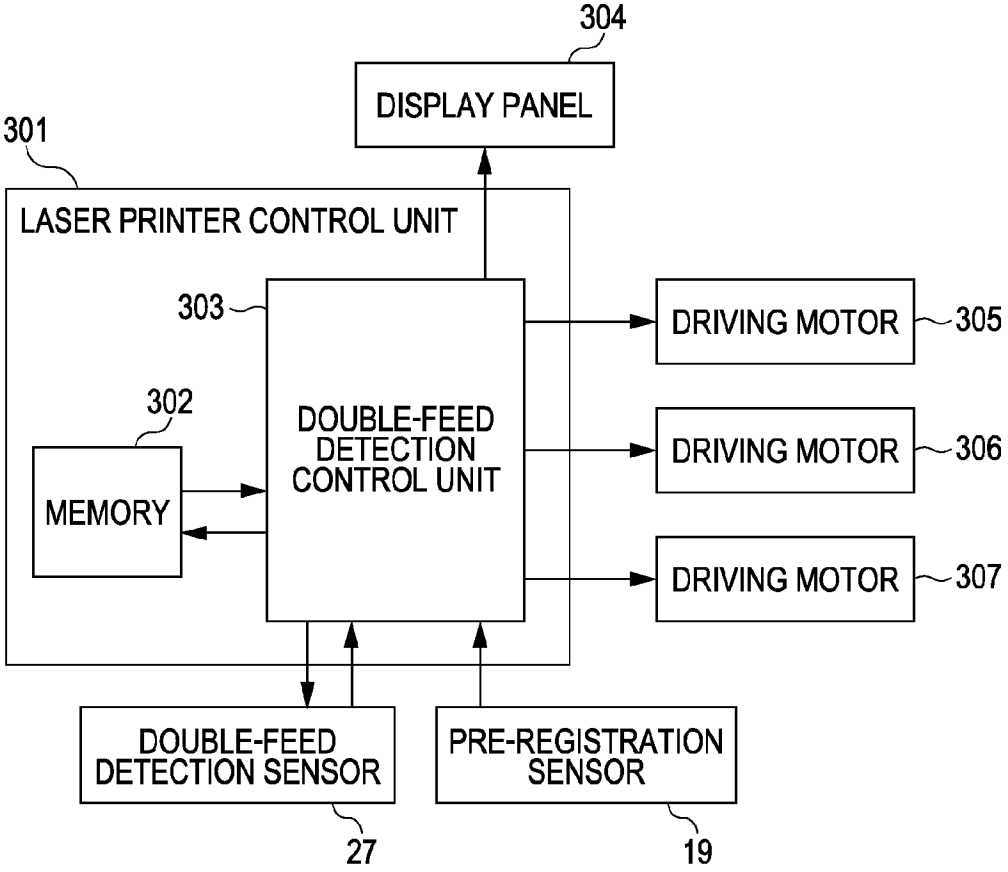
FIG. 3 is a block diagram illustrating a configuration of a double-feed detection control unit in the first exemplary embodiment.

FIG. 3 is a block diagram illustrating a configuration of the double-feed detection control unit in the first exemplary embodiment when the double-feed detection control unit is applied to the laser printer 101. Note that various components of the laser printer other than the double-feed detection control unit are not described here.

A laser printer control unit 301 for operating the laser printer 101 includes a memory 302 (storage unit) and a double-feed detection control unit 303 (detection control unit). The laser printer control unit 301 displays, on a display panel 304, information such as an error occurred in the laser printer 101.

Reference numeral 305 denotes a driving motor that drives the driving roller 18*a*, 306 denotes a driving motor that drives the registration roller 23, and 307 denotes a driving motor that drives the conveying rollers 24.

The laser printer control unit 301 executes a double-feed detection process by obtaining a value held in the memory 302 and the detection result of the pre-registration sensor 19, and by controlling the double-feed detection sensor 27 and the driving motors 305, 306 and 307. A double-feed detection apparatus employed in the laser printer 101 in this first exemplary embodiment is made up of the double-feed detection sensor 27, the memory 302, and the double-feed detection control unit 303.

<Manner of Obtaining Double-Feed Detection Position on Transfer Material in Double-Feed Detection Process>

Figure 4:
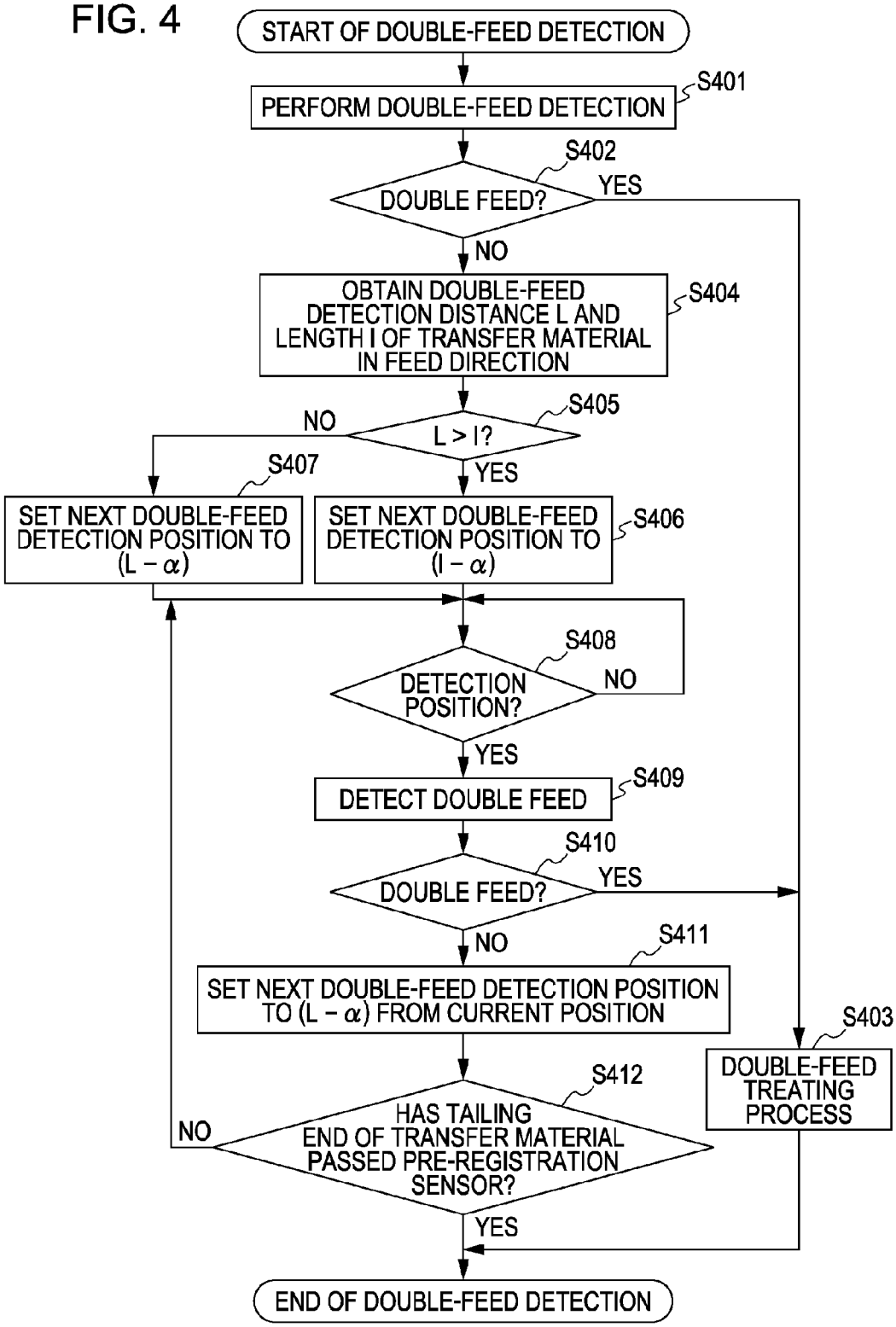
FIG. 4 is a flowchart illustrating a double-feed detection process in the first exemplary embodiment.
Figure 5:
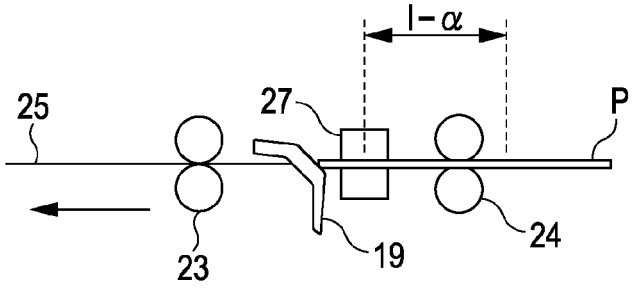
FIG. 5 illustrates a second detection position when a double-feed detection distance is larger than a length of a transfer material in the feed direction in the first exemplary embodiment.
Figure 6:
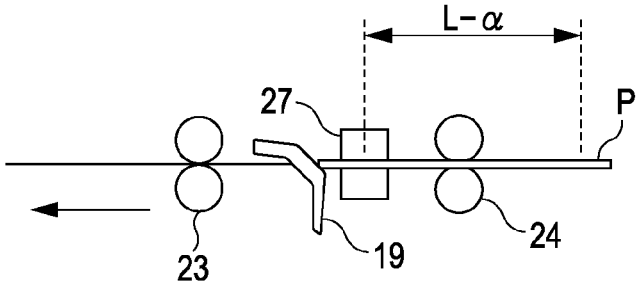
FIG. 6 illustrates a second detection position when the double-feed detection distance is not larger than the length of the transfer material in the feed direction in the first exemplary embodiment.
Figure 7:
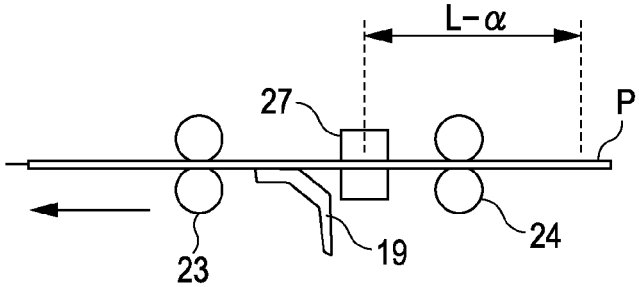
FIG. 7 illustrates a third detection position in the first exemplary embodiment.

FIG. 4 is a flowchart illustrating the double-feed detection process in the first exemplary embodiment, and each of FIGS. 5, 6 and 7 illustrates the double-feed detection position in the laser printer 101.

In this first exemplary embodiment, it is assumed that the fuser 13 as one of image forming units is a double-feed prohibition unit, and the distance from the double-feed detection sensor 27 to the fuser 13 along the conveying path 25 is a double-feed detection distance L (see FIG. 1). In other words, the occurrence of double feed is detected before the transfer materials conveyed in the double-feed state reach the fuser 13. Further, it is assumed that l represents the length of a transfer material in the feed direction, which has a minimum size among the transfer materials capable of being stacked in the paper feed tray 3, and $\alpha$ represents the distance through which the transfer material is conveyed until an image forming process is interrupted after executing the double-feed detection. Stated another way, the length l of the transfer material in the feed direction is a value that is preset on the basis of the transfer material which has a minimum size among the transfer materials capable of being stacked at each paper feed inlet (i.e., in the paper feed cassette 2 or the paper feed tray 3). A value (>0) of $\alpha$ represents a distance through which the transfer material is conveyed until, after the double-feed detection control unit 303 detects the occurrence of double feed and instructs the driving motor for conveying the transfer material to stop, the driving motor is stopped and the conveyance of the transfer material is actually stopped. The $\alpha$ is a distance transported in an inertia of the driving motor. Thus, the value of $\alpha$ is preset depending on parameters such as the conveyance speed of the transfer material and the type of the transfer material. The values of l and $\alpha$ are stored in the memory 302 (or a not-shown ROM). In addition, it is assumed that the double-feed detection process is started at a time when the laser printer 101 starts the printing operation and the leading end of the transfer material arrives at the pre-registration sensor 19. Namely, the double-feed detection process is assumed to be started with respect to a leading end portion of the transfer material.

When the double-feed detection process is started, the double-feed detection is performed on the leading end portion of the transfer material (i.e., the leading end portion thereof in the feed direction) corresponding to a first detection position (step 401 (hereinafter referred to simply as "S401")), thus determining whether double feed occurs (S402).

If the double feed is determined in S402, a double-feed treating process is executed (S403), following which the double-feed detection process is brought to an end.

In the double-feed treating process in S403, the driving motors 305, 306 and 307 are stopped to interrupt the conveyance of the transfer material (i.e., to stop the conveying operation). Thereafter, an error is notified to the display panel 304. The error is notified, for example, as a message indicating that the double feed has occurred, or that an abnormality has occurred in the conveyance of the transfer material.

On the other hand, if the double feed is not determined in S402, the double-feed detection distance L and the length l of the transfer material in the feed direction, which are stored in the memory 302, are obtained (S404).

Next, the double-feed detection distance L and the length l of the transfer material in the feed direction obtained in S404 are compared with each other (S405).

If the double-feed detection distance L is larger than the length l of the transfer material in the feed direction, a next double-feed detection position corresponding to a second detection position is set, as illustrated in FIG. 5, to a position away from the current detection position through (l−α) (i.e., a position resulting from adding a value (l−α), which is smaller than the length l of the transfer material in the feed direction, to the first detection position) (S406).

On the other hand, if the double-feed detection distance L is not larger than the length l of the transfer material in the feed direction, the next double-feed detection position corresponding to the second detection position is set, as illustrated in FIG. 6, to a position away from the current detection position through (L−α) (i.e., a position resulting from adding a value (L−α), which is not larger than the double-feed detection distance L, to the first detection position) (S407).

After waiting for that the next double-feed detection position on the transfer material reaches the double-feed detection sensor 27 (S408), the double-feed detection is executed again (S409), thus determining whether double feed occurs (S410).

If the double feed is determined in S410, the double-feed treating process in S403 is executed, following which the double-feed detection process is brought to an end. On the other hand, if the double feed is not determined in S410, the double-feed detection position is calculated in order to continuously perform the double-feed detection. More specifically, a next double-feed detection position corresponding to a third or subsequent detection position is set, as illustrated in FIG. 7, to a position away from the current detection position (at that time) through (L−α) (i.e., a third or subsequent position resulting from adding the value (L−α), which is smaller than the double-feed detection distance L, to the second detection position) (S411).

The above-described processing of S408 to S411 is executed until the tailing end of the transfer material is detected by the pre-registration sensor 19. At a time when the tailing end of the transfer material is detected, the double-feed detection process is brought to an end (S412).

According to the first exemplary embodiment, as described above, the double-feed detection can be performed plural times at proper timings depending on the double-feed detection distance L and the length l of the transfer material in the feed direction, which has a minimum size among the transfer materials capable of being stacked at the paper feed inlet. Therefore, even if dragged-in double feed occurs, the transfer material is prevented from being conveyed up to the fuser 13 which is the double-feed prohibition unit. Hence, efficiency in coping with a jam can be improved and a failure of the fuser 13 can be prevented. Moreover, wasteful consumption of the transfer materials can be avoided.

Further, since the LED 201 serving as the light-emitting unit is not required to continuously emit light over a wide range to perform samplings, degradation of the LED 201 can be suppressed and accuracy of the detection using the LED 201 can be maintained. In addition, the detection accuracy can be maintained by using an inexpensive LED without using an expensive LED.

It is be noted that the above-described first exemplary embodiment can be variously modified in conformity with the gist of the present invention and is not intended to exclude those various modifications from the scope of the invention.

The paper feed inlet in the first exemplary embodiment can be constituted by using a known paper feed cassette as the paper feed tray 3 that can hold plural sizes of paper. For example, when a cassette capable of holding B5-size paper and A4-size paper is used as the paper feed cassette, the length of the B5-size paper in the feed direction is stored as l in the memory.

In the case of an image forming apparatus, such as the laser printer 101, in which a plurality of paper feed units are employed and the length of a minimum-size transfer material in the conveying direction, which is capable of being stacked in each paper feed unit, differs between or among the paper feed units, the length l of the transfer material in the feed direction for each paper feed unit can be stored in the memory 302 and the setting length l of the transfer material in the feed direction can be changed depending on the paper feed unit selected in use.

In a second exemplary embodiment of the present invention, the timing of the double-feed detection is determined based on a detection result of a tray size sensor for detecting the length of the transfer material in the feed direction.

<Configuration of Double-Feed Detection Control Unit>

Figure 8:
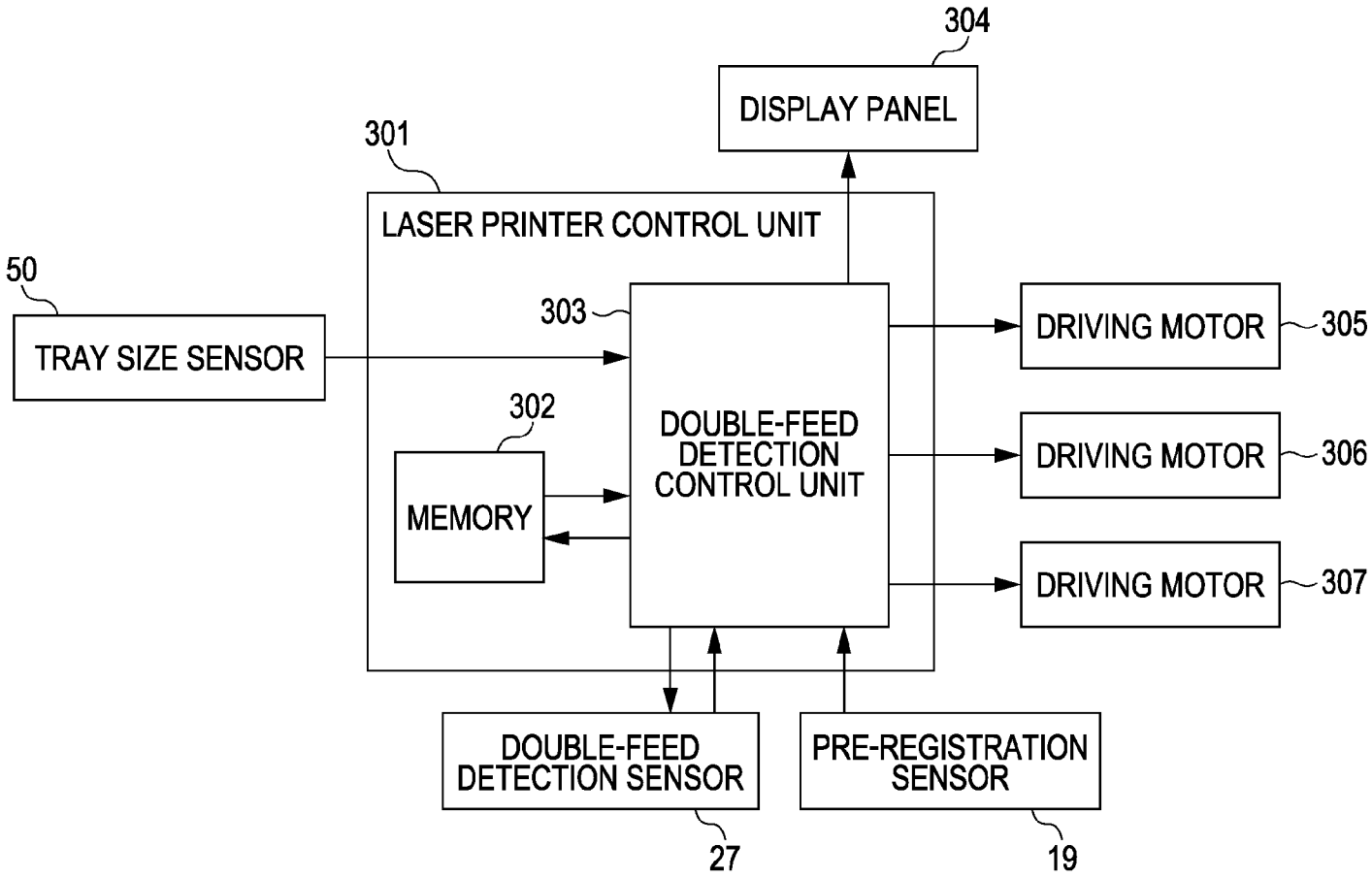
FIG. 8 is a block diagram illustrating a configuration of a double-feed detection control unit in a second exemplary embodiment.

FIG. 8 is a block diagram illustrating a configuration of a double-feed detection control unit in the second exemplary embodiment when the double-feed detection control unit is applied to the laser printer 101. Note that the components described above in the first exemplary embodiment are denoted by the same reference numerals and a description of those components is not repeated here.

Reference numeral 50 denotes a tray size sensor (i.e., a detection unit configured to detect the length of the sheet-like member in the feed direction), which is disposed within the paper feed cassette 2 and which is connected to the laser printer control unit 301. The laser printer control unit 301 calculates the length of the transfer material in the feed direction, which is present within the paper feed cassette 2, based on information obtained with the tray size sensor 50, and determines the timing of the double-feed detection based on the calculation result. The tray size sensor 50 is, e.g., a sensor configured to detect the position of a member for restricting the transfer materials set in the paper feed cassette 2. More specifically, when the paper feed cassette 2 includes a plate which is movable to slide in conformity with the sheet size (size in each of the feed direction and a direction perpendicular to the feed direction) at the time of stacking the transfer materials in the paper feed cassette 2, the tray size sensor 50 is a sensor configured to detect the sheet size from the position of the plate after the sliding. Instead of such a sensor, other type of sensor can also be used as the tray size sensor 50 so long as the sensor is able to detect the length of the transfer material in the feed direction, which is set in the paper feed cassette 2.

<Manner of Obtaining Double-Feed Detection Position on Transfer Material in Double-Feed Detection Process>

Figure 9:
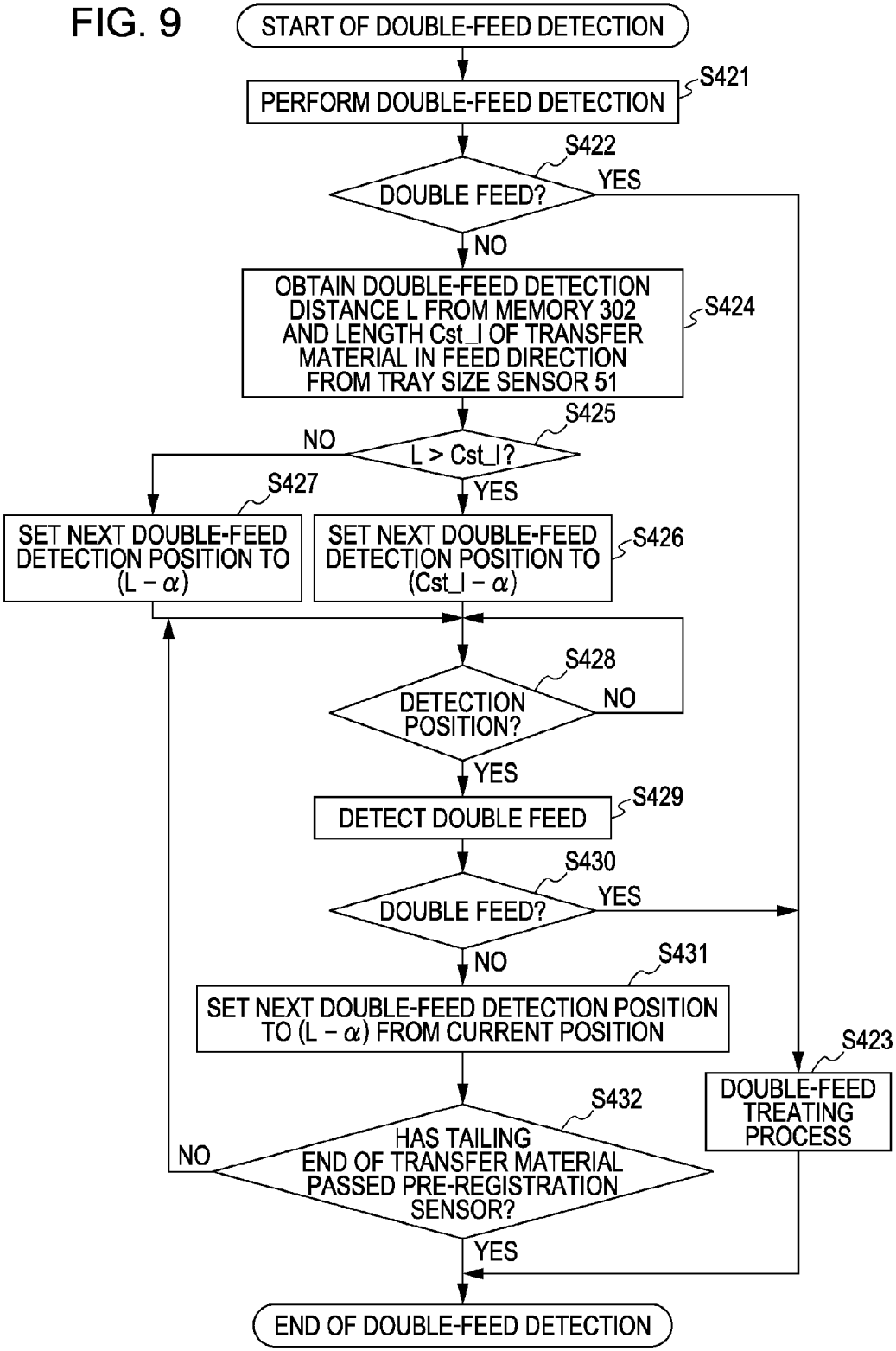
FIG. 9 is a flowchart illustrating a double-feed detection process in the second exemplary embodiment.

FIG. 9 is a flowchart illustrating a double-feed detection process in the second exemplary embodiment.

In this second exemplary embodiment, as in the first exemplary embodiment, it is assumed that the fuser 13 is the double-feed prohibition unit, and the distance from the double-feed detection sensor 27 to the fuser 13 is a double-feed detection distance L. Further, it is assumed that Cst_l represents the length of the transfer material in the feed direction, which is obtained from the tray size sensor 50, and α represents the distance through which the transfer material is conveyed until an image forming process is interrupted after executing the double-feed detection. In addition, it is assumed that the double-feed detection process is started at a time when the laser printer 101 starts the printing operation and the leading end of the transfer material arrives at the pre-registration sensor 19.

When the double-feed detection process is started, the double-feed detection is performed on a leading end portion of the transfer material corresponding to a first detection position (step 421), thus determining whether double feed occurs (S422).

If the double feed is determined in S422, a double-feed treating process is executed (S423), following which the double-feed detection process is brought to an end.

In the double-feed treating process in S423, the driving motors 305, 306 and 307 are stopped to interrupt the conveyance of the transfer material. Thereafter, an error is notified to the display panel 304. The error is notified, for example, as a message indicating that the double feed has occurred, or that an abnormality has occurred in the conveyance of the transfer material.

On the other hand, if the double feed is not determined in S422, the double-feed detection distance L is obtained from the memory 302 and the length Cst_l of the transfer material in the feed direction is obtained from the tray size sensor 50 (S424).

Next, the double-feed detection distance L and the length Cst_l of the transfer material in the feed direction both obtained in S424 are compared with each other (S425).

If the double-feed detection distance L is larger than the length Cst_l of the transfer material in the feed direction, a next double-feed detection position corresponding to a second detection position is set to a position away from the current detection position through (Cst_l−α) (S426). On the other hand, if the double-feed detection distance L is not larger than the length Cst_l of the transfer material in the feed direction, the next double-feed detection position corresponding to the second detection position is set to a position away from the current detection position through (L−α) (S427).

After waiting for that the next double-feed detection position on the transfer material reaches the double-feed detection sensor 27 (S428), the double-feed detection is executed again (S429), thus determining whether double feed occurs (S430).

If the double feed is determined in S430, the double-feed treating process in S423 is executed, following which the double-feed detection process is brought to an end. On the other hand, if the double feed is not determined in S430, a next double-feed detection position corresponding to a third or subsequent detection position is set, for continuing the double-feed detection, to a position away from the current detection position (at that time) through (L−α) (S431).

The above-described processing of S428 to S431 is executed until the tailing end of the transfer material is detected by the pre-registration sensor 19. At a time when the tailing end of the transfer material is detected, the double-feed detection process is brought to an end (S432).

According to the second exemplary embodiment, as described above, the double-feed detection can be performed plural times at proper timings depending on the double-feed detection distance and the length of the transfer material in the feed direction, which is set at the paper feed inlet. Therefore, even if dragged-in double feed occurs, the transfer material is prevented from being conveyed up to the fuser 13 which is the double-feed prohibition unit. Hence, efficiency in coping with a jam can be improved and a failure of the fuser 13 can be prevented. Moreover, wasteful consumption of the transfer materials can be avoided.

Further, since the LED 201 serving as the light-emitting unit is not required to continuously emit light over a wide range to perform samplings, degradation of the LED 201 can be suppressed and accuracy of the detection using the LED 201 can be maintained. In addition, the detection accuracy can be maintained by using an inexpensive LED without using an expensive LED.

It is be noted that the above-described second exemplary embodiment can be variously modified in conformity with the gist of the present invention and is not intended to exclude those various modifications from the scope of the invention.

In the case of an image forming apparatus, such as the laser printer 101, in which a plurality of paper feed units are employed and the length of a minimum-size transfer material in the conveying direction, which is capable of being stacked in each paper feed unit, differs between or among the paper feed units, the length Cst_l of the transfer material in the feed direction for each paper feed unit can be stored and the setting length Cst_l of the transfer material in the feed direction can be changed depending on the paper feed unit selected in use.

In a third exemplary embodiment of the present invention, the timing of the double-feed detection is determined based on a result of detecting an actual length of the transfer material in the feed direction during conveyance of the transfer material and a detection result of the tray size sensor. In this third exemplary embodiment, it is assumed that the distance from the double-feed detection sensor 27 to the fuser 13 is a double-feed detection distance L, and the distance from a feed sensor 51 (described later) to the double-feed detection sensor 27 is L2. The third exemplary embodiment will be described below in connection with the case of L≤L2 (see FIG. 10).

<Construction of Laser Printer>

Figure 10:
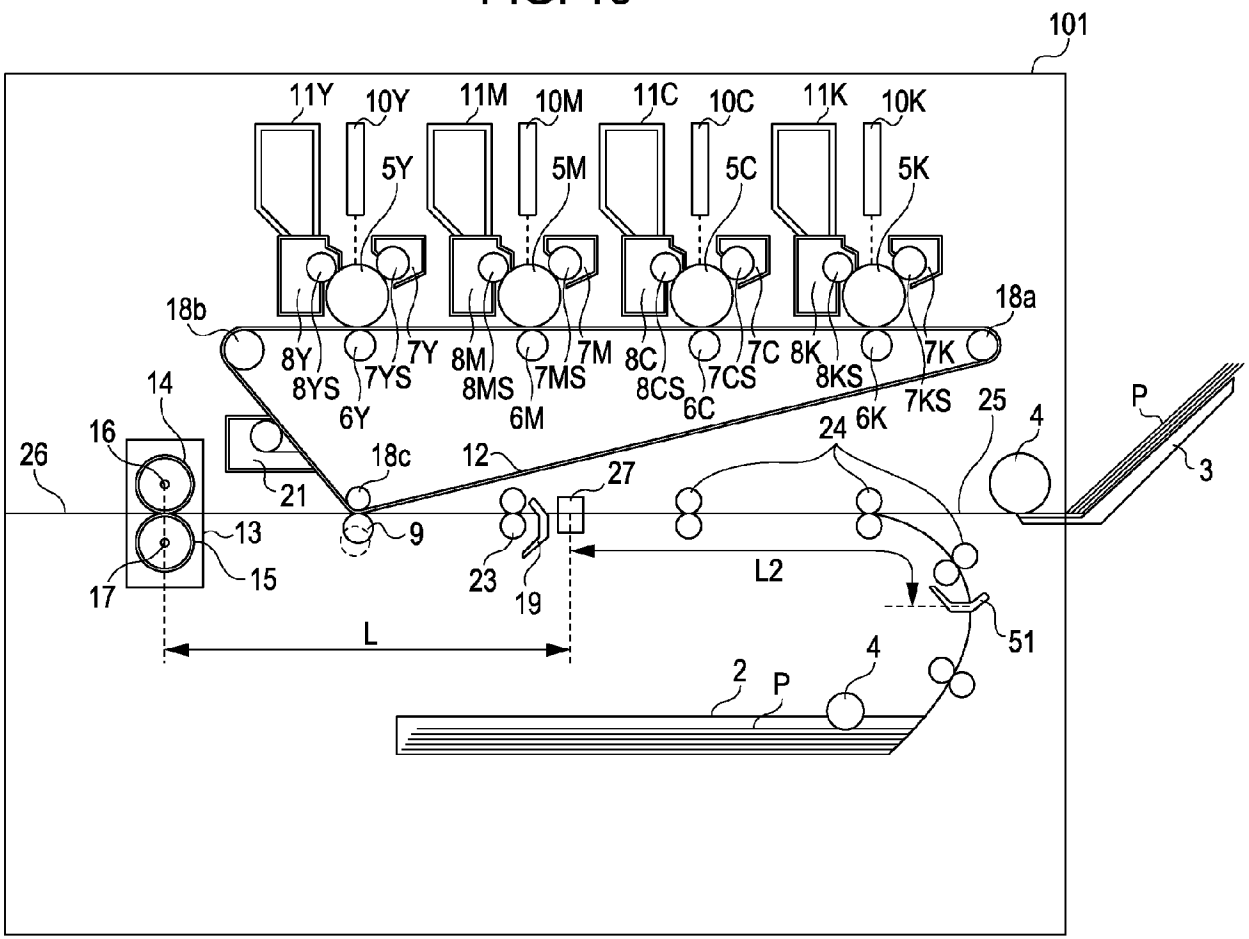
FIG. 10 illustrates an overall construction of a laser printer according to a third exemplary embodiment.

FIG. 10 illustrates an overall construction of a laser printer as an example of an image forming apparatus, which is similar to that described in the first and second exemplary embodiments. In this third exemplary embodiment, however, the feed sensor 51 is disposed near the paper feed cassette 2.

<Configuration of Double-Feed Detection Control Unit>

Figure 11:
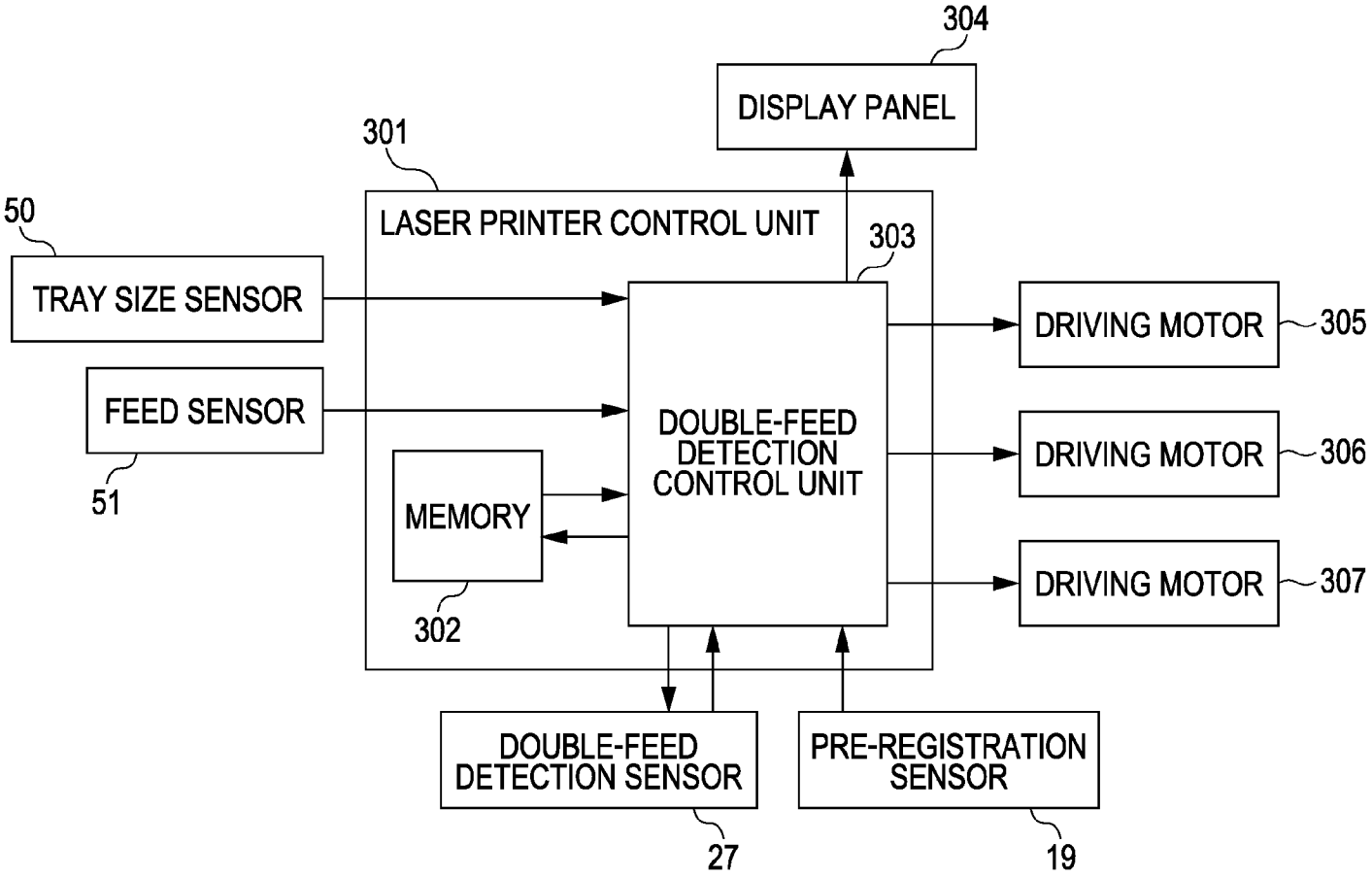
FIG. 11 is a block diagram illustrating a configuration of a double-feed detection control unit in the third exemplary embodiment.

FIG. 11 is a block diagram illustrating a configuration of a double-feed detection control unit in the third exemplary embodiment when the double-feed detection control unit is applied to the laser printer 101. Note that the components described above in the first exemplary embodiment are denoted by the same reference numerals and a description of those components is not repeated here.

The laser printer control unit 301 determines the timing of the double-feed detection based on information from the tray size sensor 50 as a first unit for detecting the length of the sheet-like member (transfer material) in the feed direction, and from the feed sensor 51 as a second unit for detecting the length of the sheet-like member (transfer material) in the feed direction. The reason why the double feed is determined based on the information from both the tray size sensor 50 and the feed sensor 51 in this third exemplary embodiment is as follows.

For example, in a state that the paper feed cassette 2 is set as a cassette for stacking A4-size sheets (transfer materials), a user may erroneously set B5-size sheets (transfer materials) in the paper feed cassette 2. In that case, if the double-feed detection is performed based on the information from the tray size sensor 50, the double-feed detection cannot be correctly performed. Even in such a situation, this third exemplary embodiment can ensure reliable double-feed detection.

<Manner of Obtaining Double-Feed Detection Position on Transfer Material in Double-Feed Detection Process>

Figure 12:
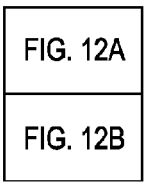
FIG. 12 is a flowchart illustrating a double-feed detection process in the third exemplary embodiment.
Figure 12A:
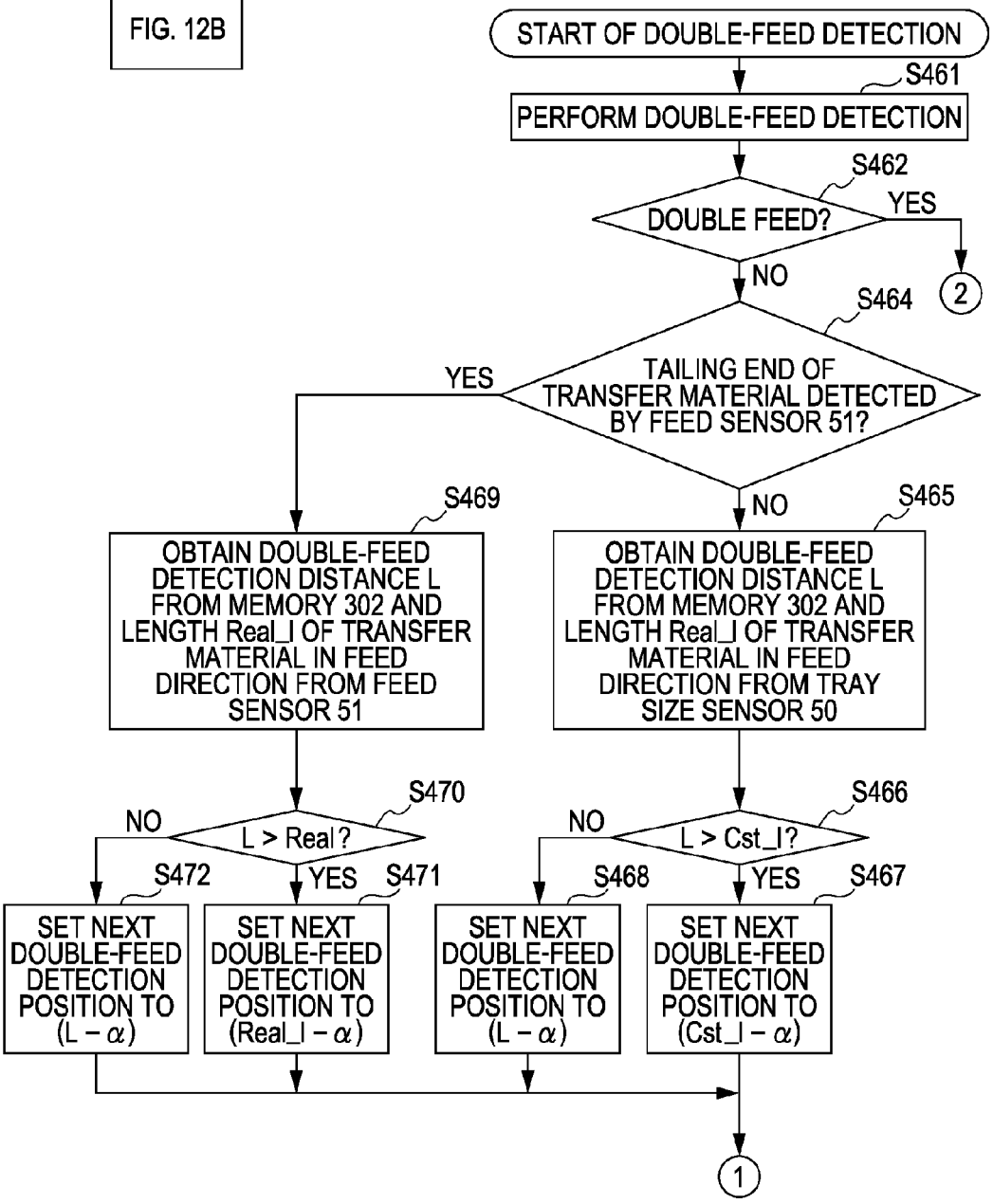
Figure 12B:
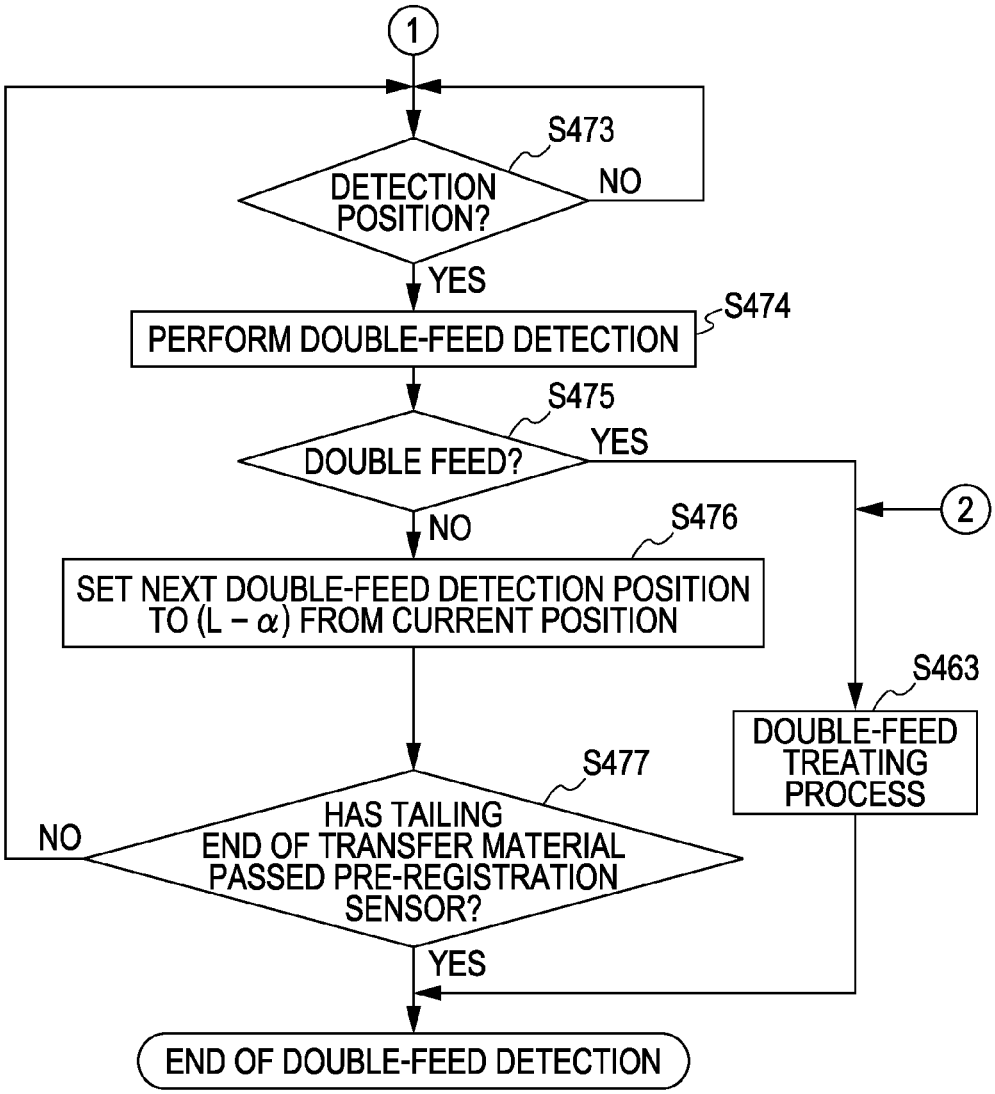

FIG. 12 is a flowchart illustrating a double-feed detection process in the third exemplary embodiment.

In this third exemplary embodiment, as in the first and second exemplary embodiments, it is assumed that the fuser 13 is the double-feed prohibition unit, the distance from the double-feed detection sensor 27 to the fuser 13 is a double-feed detection distance L, and the distance from the feed sensor 51 to the double-feed detection sensor 27 is L2. Further, it is assumed that Real_l represents the length of the transfer material in the feed direction, which is obtained from the feed sensor 51, and $\alpha$ represents the distance through which the transfer material is conveyed until an image forming process is interrupted after executing the double-feed detection. In addition, it is assumed that the double-feed detection process is started at a time when the laser printer 101 starts the printing operation and the leading end of the transfer material arrives at the pre-registration sensor 19.

When the double-feed detection process is started, the double-feed detection is performed on a leading end portion of the transfer material corresponding to a first detection position (step 461), thus determining whether double feed occurs (S462).

If the double feed is determined in S462, a double-feed treating process is executed (S463), following which the double-feed detection process is brought to an end.

In the double-feed treating process in S463, the driving motors 305, 306 and 307 are stopped to interrupt the conveyance of the transfer material. Thereafter, an error is notified to the display panel 304. The error is notified, for example, as a message indicating that the double feed has occurred, or that an abnormality has occurred in the conveyance of the transfer material.

On the other hand, if the double feed is not determined in S462, it is determined whether the tailing end of the transfer material has passed the feed sensor 51 and the actual length of the transfer material in the feed direction has been confirmed (S464). If the actual length of the transfer material in the feed direction is not confirmed, the double-feed detection distance L is obtained from the memory 302 and the length Cst_l of the transfer material in the feed direction is obtained from the tray size sensor 50 (S465). Next, the double-feed detection distance L and the length Cst_l of the transfer material in the feed direction both obtained in S465 are compared with each other (S466).

If the double-feed detection distance L is larger than the length Cst_l of the transfer material in the feed direction, a next double-feed detection position corresponding to a second detection position is set to a position away from the current detection position through (Cst_l−$\alpha$) (S467). On the other hand, if the double-feed detection distance L is not larger than the length Cst_l of the transfer material in the feed direction, the next double-feed detection position corresponding to the second detection position is set to a position away from the current detection position through (L−$\alpha$) (S468).

If the actual length of the transfer material in the feed direction is confirmed in S464, the double-feed detection distance L is obtained from the memory 302 and the length Real_l of the transfer material in the feed direction is obtained from the feed sensor 51 (S469). Next, the double-feed detection distance L and the length Real_l of the transfer material in the feed direction both obtained in S469 are compared with each other (S470).

If the double-feed detection distance L is larger than the length Real_l of the transfer material in the feed direction, a next double-feed detection position corresponding to a second detection position is set to a position away from the current detection position through (Real_l−$\alpha$) (S471). On the other hand, if the double-feed detection distance L is not larger than the length Real_l of the transfer material in the feed direction, the next double-feed detection position corresponding to the second detection position is set to a position away from the current detection position through (L−$\alpha$) (S472).

After waiting for that the next double-feed detection position on the transfer material reaches the double-feed detection sensor 27 (S473), the double-feed detection is executed again (S474), thus determining whether double feed occurs (S475).

If the double feed is determined in S475, the double-feed treating process in S463 is executed, following which the double-feed detection process is brought to an end. On the other hand, if the double feed is not determined in S475, a next double-feed detection position corresponding to a third or subsequent detection position is set, for continuing the double-feed detection, to a position away from the current detection position (at that time) through (L−$\alpha$) (S476).

The above-described processing of S473 to S476 is executed until the tailing end of the transfer material is detected by the pre-registration sensor 19. At a time when the tailing end of the transfer material is detected, the double-feed detection process is brought to an end (S477).

According to the third exemplary embodiment, as described above, the double-feed detection can be performed plural times at proper timings depending on the double-feed detection distance and the length of the transfer material in the feed direction, which is set at the paper feed inlet, or the actual length of the transfer material detected during the conveyance. Therefore, even if dragged-in double feed occurs, the transfer material is prevented from being conveyed up to the fuser 13 which is the double-feed prohibition unit. Hence, efficiency in coping with a jam can be improved and a failure of the fuser 13 can be prevented. Moreover, wasteful consumption of the transfer materials can be avoided.

Further, since the LED 201 serving as the light-emitting unit is not required to perform samplings over a wide range, degradation of the LED 201 can be suppressed and accuracy of the detection using the LED 201 can be maintained. In addition, the detection accuracy can be maintained by using an inexpensive LED without using an expensive LED.

It is be noted that the above-described third exemplary embodiment can be variously modified in conformity with the gist of the present invention and is not intended to exclude those various modifications from the scope of the invention.

For example, when the paper feed inlet is constituted by a free size cassette (not shown) or the like which allows a user to set transfer materials of desired sizes therein, the double feed can be detected by employing only the operation in which the double-feed detection process is executed using the length of the transfer material in the feed direction obtained from the feed sensor 51 and the double-feed detection distance L, as described above in the third exemplary embodiment.

In the case using the free size cassette, because the user can set transfer materials of desired sizes, the size of the transfer material is uncertain (i.e., the sheet size is not definite at a time when the transfer material starts to be fed). Therefore, the double-feed detection process can be performed in accordance with a flowchart obtained by excluding S465, S466, S467 and S468 from the flowchart of FIG. 12 described above in the third exemplary embodiment. The use of the free size cassette can be designated by previously setting the paper feed inlet for the free size cassette, or designated in accordance with an instruction from the user or a print command. Such a modified exemplary embodiment can reliably detect the double feed even when the size of the transfer material is uncertain, while providing similar advantages to those of the first to third exemplary embodiments.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

What is claimed is:

1. A recording material detection device comprising:

a detection unit configured to detect a plurality of recording materials overlapping one another being conveyed;

a first conveyance unit disposed on an upstream side of the detection unit in a conveyance direction of a recording material and configured to convey a recording material;

a second conveyance unit disposed on a downstream side of the detection unit in the conveyance direction of the recording material and configured to convey the recording material;

a control unit configured to, in a case where a plurality of recording materials overlapping one another being conveyed is detected by the detection unit, control the first conveyance unit so that the plurality of recording materials overlapping one another is stopped before reaching the second conveyance unit; and a determination unit configured to compare a value according to a distance from the detection unit to the second conveyance unit and a value according to a length of the recording material in the conveyance direction and determine detection timing by the detection unit based on a larger one of the values.

2. The recording material detection device according to claim 1, wherein the detection unit detects a plurality of positions of a recording material being conveyed after a leading end of the recording material reaches the detection unit.

3. The recording material detection device according to claim 1, wherein the detection unit is configured to perform a detection operation at least twice after the leading end of the recording material reaches the detection unit, and wherein the determination unit is configured to determine a timing to execute the second detection operation performed after executing the first detection operation based on a larger one of the values.

4. The recording material detection device according to claim 1, wherein the detection unit includes a light-emitting unit and a light-receiving unit and is configured to receive light having been emitted from the light-emitting unit and passed through the recording material by the light-receiving unit and to detect overlapping recording materials based on a light quantity of the light received by the light-receiving unit.

5. An image forming apparatus comprising:

a conveyance unit disposed on an upstream side of a detection unit in a conveyance direction of a recording material and configured to convey a recording material;

an image forming unit disposed on a downstream side of the detection unit in the conveyance direction of the recording material and configured to form an image on the recording material;

the detection unit configured to detect a plurality of recording materials overlapping one another being conveyed toward the image forming unit;

a control unit configured to, in a case where a plurality of recording materials overlapping one another being conveyed is detected by the detection unit, control the conveyance unit so that the plurality of recording materials overlapping one another is stopped before reaching the image forming unit; and a determination unit configured to compare a value according to a distance from the detection unit to the image forming unit and a value according to a length of the recording material in the conveyance direction and determine detection timing by the detection unit based on a larger one of the values.

6. The image forming apparatus according to claim 5, wherein the detection unit detects a plurality of positions of a recording material being conveyed after a leading end of the recording material reaches the detection unit.

7. The image forming apparatus according to claim 5, wherein the image forming unit includes either a transfer unit configured to transfer an image onto a recording material or a fixing unit configured to fix an image formed on a recording material on the recording material.

8. The image forming apparatus according to claim 5, wherein the detection unit is configured to perform a detection operation at least twice after the leading end of the recording material reaches the detection unit, and wherein the determination unit is configured to determine a timing to execute the second detection operation performed after executing the first detection operation based on a larger one of the values.

9. The image forming apparatus according to claim 5, wherein the detection unit includes a light-emitting unit and a light-receiving unit and is configured to receive light having been emitted from the light-emitting unit and passed through the recording material by the light-receiving unit and to detect overlapping recording materials based on a light quantity of the light received by the light-receiving unit.

* * * * *